US009658637B2

(12) United States Patent
Marinca

(10) Patent No.: US 9,658,637 B2
(45) Date of Patent: May 23, 2017

(54) LOW POWER PROPORTIONAL TO ABSOLUTE TEMPERATURE CURRENT AND VOLTAGE GENERATOR

(71) Applicant: Analog Devices Global, Hamilton (BM)

(72) Inventor: Stefan Marinca, Limerick (IE)

(73) Assignee: Analog Devices Global, Hamilton (BM)

( * ) Notice: Subject to any disclaimer, the term of this patent is extended or adjusted under 35 U.S.C. 154(b) by 358 days.

(21) Appl. No.: 14/182,877

(22) Filed: Feb. 18, 2014

(65) Prior Publication Data

US 2015/0234414 A1 Aug. 20, 2015

(51) Int. Cl.
*G05F 3/26* (2006.01)
*G05F 3/30* (2006.01)

(52) U.S. Cl.
CPC ..... *G05F 3/262* (2013.01); *G05F 3/30* (2013.01)

(58) Field of Classification Search
CPC ... G05F 3/30; G05F 3/02; G05F 3/262; G05F 3/267; G05F 3/16; G05F 3/20; G05F 3/265
USPC ..... 327/109, 312, 350, 427, 538, 539, 540, 327/542
See application file for complete search history.

(56) References Cited

U.S. PATENT DOCUMENTS 6,894,473 B1 * 5/2005 Le ..... G05F 3/30 323/314
2005/0194957 A1 * 9/2005 Brokaw ..... G05F 3/30 323/316
2005/0231273 A1 * 10/2005 Whittaker ..... G05F 3/267 327/543
2006/0001413 A1 * 1/2006 Marinca ..... G05F 3/30 323/315
2006/0208790 A1 9/2006 Tadeparthy et al.
2006/0250178 A1 11/2006 Gierkink
2013/0038317 A1 2/2013 Marinca

FOREIGN PATENT DOCUMENTS

CN 1732419 A 2/2006
CN 102207741 A 10/2011

OTHER PUBLICATIONS

Analog Devices, "Ultralow Noise, High Accuracy Voltage References," Data Sheet ADR4520/ADR4525/ADR4530/ADR4533/ADR4540/ADR4550, Rev. 0, Apr. 2012, pp. 1-32.
"Chinese Application Serial No. 201510078549.7, Office Action mailed Jul. 7, 2016", (w/ English Translation), 16 pgs.
"Chinese Application Serial No. 201510078549.7, Office Action mailed Feb. 2, 2016", 5 pgs.
"German Application Serial No. 102015101319.3, Office Action dated Nov. 8, 2016", (w/ English Abstract), 18 pgs.

* cited by examiner

*Primary Examiner* — John Poos
(74) *Attorney, Agent, or Firm* — Schwegman Lundberg & Woessner, P.A.

(57) ABSTRACT

A proportional to absolute temperature (PTAT) circuit is provided. By judiciously combining circuit elements into two or more cell it is possible to effectively dump bias current into impedance resistive element of a first cell from other cells of the circuit. As a result the circuit as a whole can operate with smaller resistive elements and therefore occupy less area when implemented in silicon. It is also possible to reduce the supply current that is required for providing specific output currents or voltages.

25 Claims, 8 Drawing Sheets

LOW POWER PROPORTIONAL TO ABSOLUTE TEMPERATURE CURRENT AND VOLTAGE GENERATOR

FIELD OF THE INVENTION

The present disclosure relates to a method and apparatus for generating an output that is temperature dependent. More particularly the present disclosure relates to a methodology and circuitry configured to provide an output signal that is proportional to absolute temperature. Such an output signal can be used in temperature sensors, bandgap type voltage references and different analog circuits.

BACKGROUND

It is well known that temperature affects the performance of electrical circuitry. The resistance or conductivity of electrical components varies dependent on the temperature of the environment within which they are operating. Such understanding can be used to generate circuits or sensors whose output varies with temperature and as such function as temperature sensors. The output of such circuits can be a proportional to absolute temperature (PTAT) output or can be a complimentary to absolute temperature (CTAT) output. A PTAT circuit will provide an output that increases with increases in temperature whereas a CTAT circuit will provide an output that decreases with increases in temperature.

PTAT and CTAT circuits are widely used in temperature sensors, bandgap type voltage references and different analog circuits. A voltage which is proportional to absolute temperature (PTAT) may be obtained from the base-emitter voltage difference of two bipolar transistors operating at different collector current densities. A corresponding PTAT current can be generated by reflecting the base-emitter voltage difference across a resistor. With a second resistor of the same type and having the same or similar temperature coefficient (TC), the base-emitter voltage difference can be gained to the desired level.

Within the art, there is a continuous need for circuits that can provide such voltages and/or currents but which have reduced power requirements.

SUMMARY

These and other problems are addressed a proportional to absolute temperature, (PTAT) circuit provided in accordance with the present teaching. By judiciously combining circuit elements it is possible to generate a voltage or a current at an output node of the circuit that is temperature dependent. The circuit elements include a first set of components that are configured relative to one another to provide a bias current generator. Desirably this first set of components comprises bipolar transistors and the components are also configured to generate a signal that is proportional to a differential in base emitter voltages of two bipolar transistors, $\Delta V_{BE}$. This first set of components also comprises a resistive load coupled to a first one of the bipolar transistors.

A second set of components are coupled to this first set of components. The second set of components operably provides a bias current to the resistive load of the first set of components. By effectively dumping bias current onto this resistive load the circuit as a whole can operate with smaller resistive loads and therefore occupy less area when implemented in silicon. It is also possible to reduce the supply current that is required for providing specific output currents or voltages. This second set of components may also function as a PTAT voltage generator. In such implementations it too may comprise bipolar transistors and the components are also configured to generate a signal that is proportional to a differential in base emitter voltages of two bipolar transistors, $\Delta V_{BE}$.

Such a PTAT circuit is particularly usefully employed as a low power proportional to absolute temperature current or voltage generator. It can be used as a temperature sensor or can be combined with other temperature dependent circuits to provide a voltage reference.

BRIEF DESCRIPTION OF THE DRAWINGS

Embodiments which are provided to assist with an understanding of the present teaching will now be described, by way of example, with reference to the accompanying drawings, in which.

DETAILED DESCRIPTION

The present teaching provides a proportional to absolute temperature (PTAT) circuit which is configured to generate a voltage at an output node of the circuit that is temperature dependent. The circuit comprises a plurality of circuit elements that are coupled to a single biasing current. Desirably, the circuit elements comprise at least two sub-circuits. The first sub-circuit operates as bias current generator and a first PTAT voltage cell. The second sub-circuit is biased from the first sub-circuit such that all bias currents are returned to the common node where the bias current is generated. Such a PTAT circuit can be used as a temperature sensor or can be combined with other temperature dependent circuits to provide a voltage reference.

Using known methodologies it will be appreciated that a PTAT voltage can be changed to a PTAT current should the need arise. For example, a PTAT current can be generated by replicating across a resistor a base-emitter voltage difference of two bipolar transistors operating at different collector current density. When low current in a small silicon area is to be generated, a MOS transistor operating in its triode region can be used. It will be appreciated that the "on" resistance of a MOS transistor operating in triode region is not well controlled such that if accuracy is required then a use of resistors is preferred.

A circuit provided in accordance with the present teaching offers a solution to the problem of how to generate low bias currents based on low resistor value.

Figure 1:
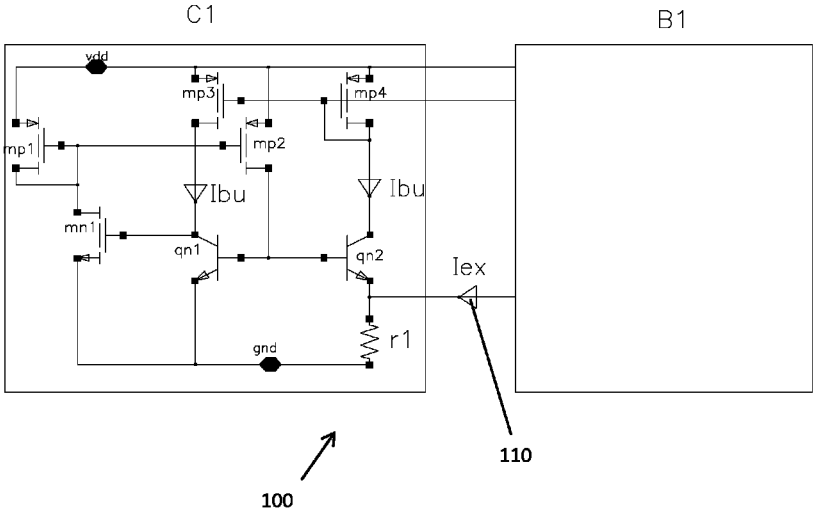
FIG. 1 is a schematic showing components of an illustrative circuit provided in accordance with the present teaching.

The present teaching will now be described with reference to exemplary arrangements. As shown in FIG. 1 the present teaching provides a proportional to absolute temperature (PTAT) circuit 100 which is configured to provide a bias current and a PTAT voltage at an output thereof. The circuit 100 comprises a plurality of circuit elements including bipolar transistors, which are arranged relative to one another such that the voltage provided at an output node 110 is dependent on the emitter ratio between the individual transistors and the number of stacked cells.

In the arrangement of FIG. 1 the circuit elements are provided in two blocks or cells. A first block, C1, provides a bias current generator. A second block, B1, is coupled to the first block, C1, and is configured to generate a current that can be injected into the first block. The circuit elements of the first block include two bipolar transistors, qn1 and qn2, which are operating at different collector current densities. A resistive load, r1, couples the emitter of bipolar transistor qn2 to ground and the value of the unity bias current, $I_{bu}$, corresponds to the ratio of the base-emitter voltage difference between qn2 and qn1 and the value of the resistor r1. If the return current from the cell B1 is zero then the unity bias current, $I_{bu}$, of the bias current generator is determined from the relationship below:

$$I_{bu} = \frac{\frac{KT}{q}\ln(n)}{r_1} \tag{1}$$

This unity bias current is used to bias each of these bipolar transistors. This current is provided by a pair of PMOS devices, mp3 and mp4, which are provided having the same aspect ratio and arranged as current mirror. A voltage-controlled current amplifier consisting of MOS devices mn1, mp1 and mp2 is configured to generate base currents of the two bipolar transistors, qn1 and qn2.

While FIG. 1 shows the block B1 as an abstract block, one function of the block is to generate a bias current that can be returned into block C1. Details of exemplary configurations will be described below. For the purposes of discussion of FIG. 1, it is sufficient to understand that as the circuit components of C1 are already biased by a bias current, $I_{bu}$, it is important to ensure that the current, $I_{ex}$, returned by B1 has the same temperature variation as that generated internally within C1. To assist in this, circuit elements inside the block B1 are biased from the same biased voltage as C1, the gate to source voltage of MOS device mp4. For the purposes of the present teaching it may be assumed that the base currents of bipolar transistors qn3 and qn4 are negligible. By coupling the return current from B1 to the top of the resistor r1, it will be seen that there are two currents injected in r1, $I_{bu}$, and $I_{ex}$. The value of the resistor r1 is determined from the equation 2 below:

$$r_1 = \frac{\frac{KT}{q}\ln(n)}{I_{bu} + I_{ex}} \tag{2}$$

It will be appreciated that $I_{ex}$ represents the returned current from the cell B1. As can be seen the base-emitter voltage difference, $\Delta V_{BE}$, is based on the collector current density ratio of the bipolar transistors inside the cell C1, qn1 and qn2. The current passing r1 is $I_{bu}+I_{ex}$. In this way the value of $r_1$ and its corresponding silicon area, can be reduced by increasing the ratio of $I_{ex}/I_{bu}$.

Figure 2:
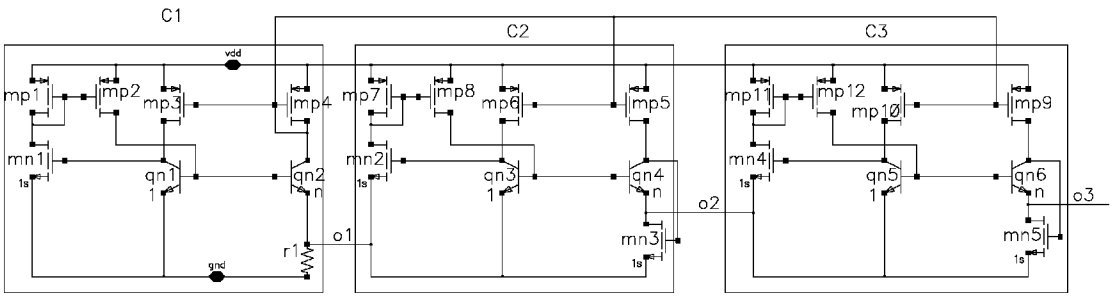
FIG. 2 is a schematic showing more detail of the illustrative circuit of FIG. 1.

FIG. 2 shows more detail of circuit components that can be employed within the context of the present teaching. As was discussed above, the block C1 includes first and second PMOS devices, mp3 and mp4, that are configured as a current mirror and are used to provide an internally generated bias current $I_{bu}$ to the top of the resistor r1. In this schematic, the block function B1 is separated out into two separate blocks C2 and C3. In this example of the implementation of functionality of a the block B1, the cells C2 and C3 are individual PTAT voltage cells generating at their output node corresponding base-emitter voltage difference based on the collector current density ratio of the two bipolar transistors inside each of the two cells. However, it will be appreciated from the above that it is not essential that these cells provide additional PTAT voltage generators, as the cell C1 already functions as a PTAT voltage generator such that absent additional PTAT voltage generating circuit component, the circuit as a whole functions as PTAT voltage generator. A primary function of the circuit components of B1 therefore is to return an additional bias current into C1 that can be combined with the bias current internally generated within C1 to reduce the overall value of the resistance required for the resistive load r1. To ensure that the returned bias current exhibits the same temperature characteristics as the internally generated bias current from C1, circuit elements inside the block B1 may be biased from the same biased voltage as C1, the gate to source voltage of MOS device mp4. However, as was mentioned above, in addition to the provision of an additional bias current into C1, it is also possible to configure the circuit components within B1 to provide additional PTAT voltage generating cells FIG. 2 shows individual circuit components within each of blocks C2 and C3. First and second MOS devices mp5, mp6, of the cell C2, are arranged in a current mirror configuration. These devices are coupled to the PMOS devices mp3, mp4 in block C1, such that the gate to source voltage of device mp4 is used to bias devices mp5, mp6. The third and fourth MOS devices, mp7 and mp8, of the cell C2, are arranged, similarly to cell C1, into a voltage controlled current amplifier which also includes NMOS device mn2. This amplifier is used to provide the bias current to two bipolar transistors qn3, qn4.

As the devices of block C2 are similar to that of devices C1 and are biased with the same currents as that within block C1, the circuit components of block C2 generate an output voltage which is similar in form to that generated in block C1. Specifically, as the bipolar transistors qn3, qn4 are similar to the devices qn1, qn2 of block C1 and are biased with a similar bias current they generate a similar voltage, $\Delta V_{BE}$, to that generated in cell C1. In the context of cell C2 this is generated at the drain terminal of a NMOS device, mn3. In this way the block C2 also generates a PTAT voltage of the form, $\Delta V_{BE}$. It will therefore be appreciated that a combination of blocks C1 and C2 generates a first and second $\Delta V_{BE}$ voltage for the overall circuit.

The current, $I_{ex}$, representing the sum of all bias currents from cells C2 and C3, is coupled into the block C1 at the top of the resistive element r1. As this current has been generated from biasing devices that are similar in form to that of the component devices of the cell C1 with a voltage that originates from cell C1, the current $I_{ex}$ is similar to that of current $I_{bu}$.

In a similar fashion to block C2, block C3 comprises two sets of PMOS devices mp9, mp10 and mp11, mp12 each set provided in a current mirror configuration. Devices mp9, mp10 are coupled to the current mirror mp5, mp6 of block C2 such that the original bias current $I_{bu}$ originating from block C1 is also used to bias the circuit components of this block. In a similar fashion to that described above, first and second bipolar transistors qn5, qn6 are arranged within the circuit block C3 to generate a voltage of the form $\Delta V_{BE}$, at the drain of an NMOS device mn5.

A further NMOS device mn4 is also coupled to the third and fourth MOS devices mp11, mp12 of block C3 acting as a current amplifier to supply the base currents for qn5 and qn6 into the block C2.

It will be appreciated that multiple such blocks C2, C3 can be replicated and cascaded relative to one another to generate multiple voltages of the form $\Delta V_{BE}$. Each block or cell C2, C3 generates a PTAT voltage based on a differential between base emitter voltages, $\Delta V_{BE}$.

It is further evident that in the schematic of FIG. 2, assuming that the base currents of the bipolar transistors are negligible, there are five currents dumped on r1, one from qn2 of C1 and four from C2 and C3.

If m identically $\Delta V_{BE}$ cells are to be stacked the value of the resistor r1 is set as:

$$r_1 = \frac{\frac{KT}{q}\ln(n)}{(2m-1)*I_{bu}} \tag{3}$$

Here n is the collector current density ratio of qn1 to qn2 in C1 and m is the number of stacked cells.

It will be appreciated from the above that by stacking multiple cells relative to a base cell C1 that generates the common bias current and also generates a voltage of the form $\Delta V_{BE}$, that a much lower resistor generates the same unity bias current and furthermore three sets of bipolar transistors (using the example of the three cells C1, C2, C3 of FIG. 2) can used to generate a PTAT voltage of the form of 3 $\Delta V_{BE}$.

It will be appreciated by those of ordinary skill that when providing such circuits in silicon that forming a resistor may require more silicon surface area than other components such as transistors. By reducing the size of the resistor that is required to generate the same unity bias current as conventional circuitry, circuits in accordance with the present teaching can be implemented using less silicon area than such conventional circuits. Exemplary simulation results show that the occupied silicon area can be more than five times smaller for a circuit per the present teaching as opposed to conventional circuits that generate the same output. In order to demonstrate the performance of a circuit provided in accordance with the present teaching as compared to conventional circuits that generate a bias current using a separate bias current generator, two circuits were simulated. The first circuit uses a separate bias current generator, per the teaching of known implementations, whereas the second circuit incorporates a bias current generator provided in accordance with the present teaching. It will be appreciated from the above description of FIGS. 1 and 2, that a circuit provided in accordance with the present teaching requires one less individual cell to generate the same output PTAT voltage as compared to a conventional circuit which requires a separate bias current generating cell in addition to individual $\Delta V_{BE}$ cells.

Figure 3:
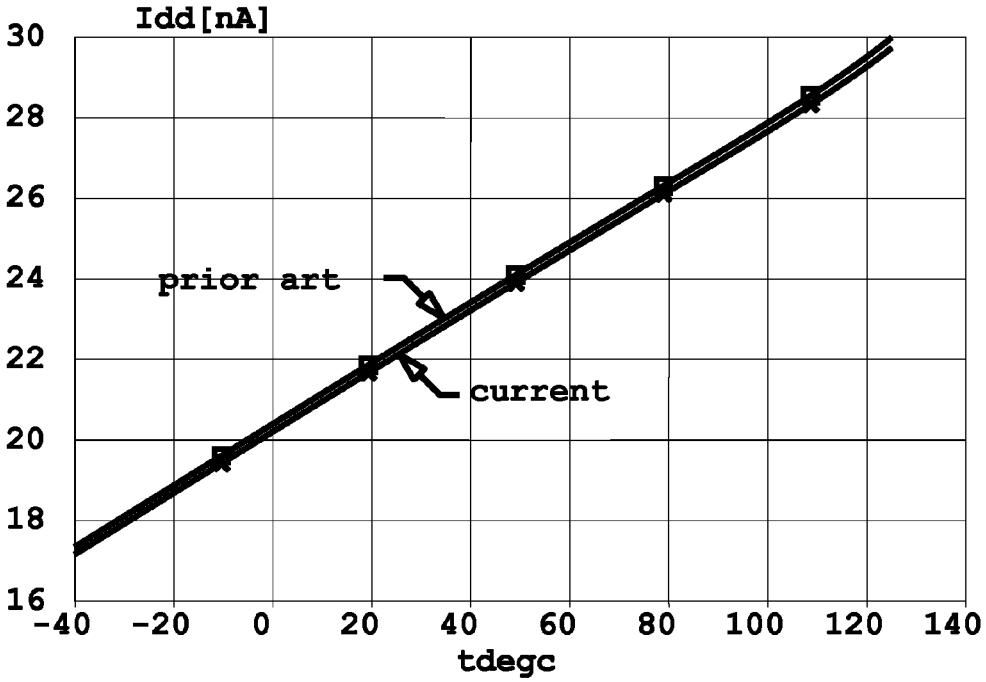
FIG. 3 is a graph showing simulation data of the supply current of the circuit of FIG. 1 verses temperature in comparison to that for a known circuit.
Figure 4:
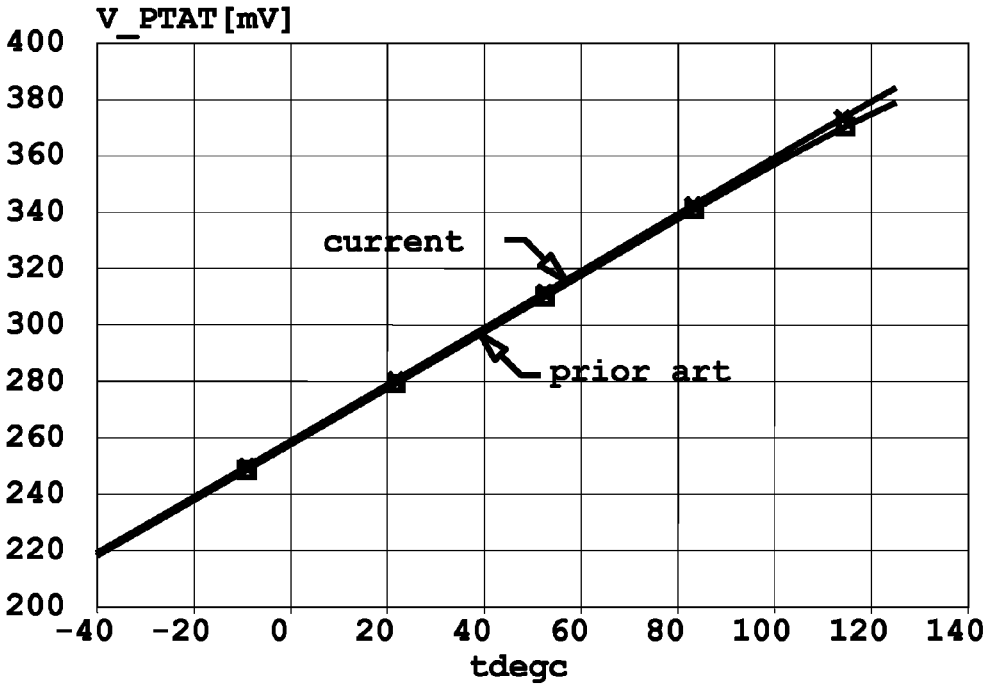
FIG. 4 is a graph showing simulation data of the output PTAT voltage verses temperature for the circuit of FIG. 1, as compared to that of a known circuit.
Figure 5:
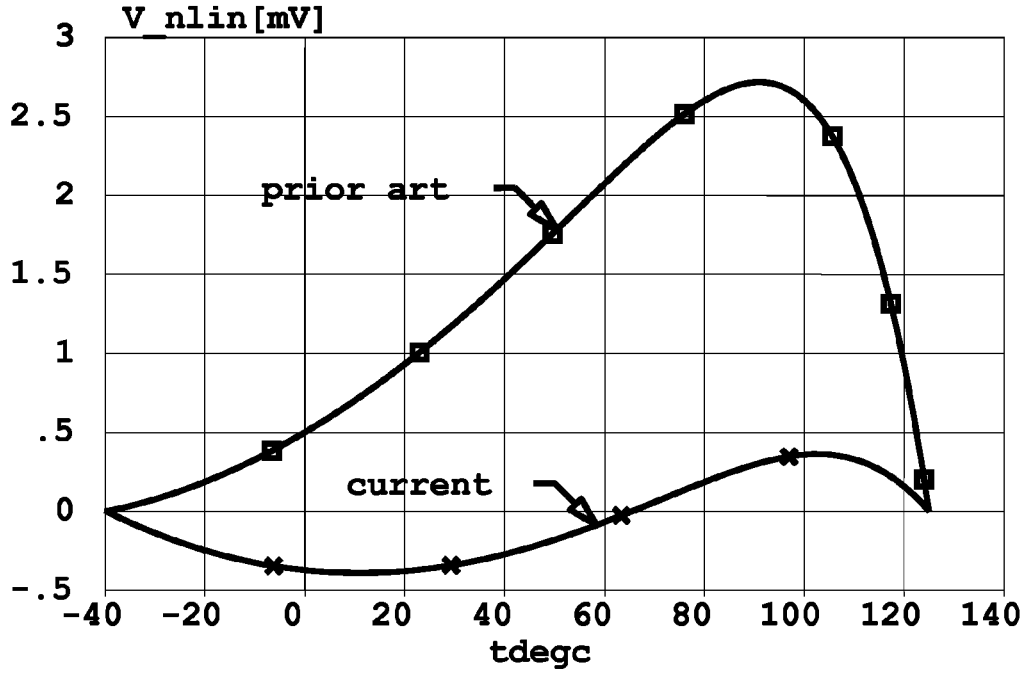
FIG. 5 is a graph showing simulation data of non-linearities of the response of the circuit of FIG. 1, as compared to that of a known circuit.

As shown in FIGS. 3 and 4, while a circuit per the present teaching may occupy smaller area its response in a graph of simulated supply current verses temperature (FIG. 3) or output PTAT voltage verses temperature (FIG. 4) is very similar to the performance of conventional circuits. However, as shown in FIG. 5, its non-linearity response or deviation from straight line is about seven times less as compared to the corresponding nonlinearity of a conventional circuit.

Figure 6:
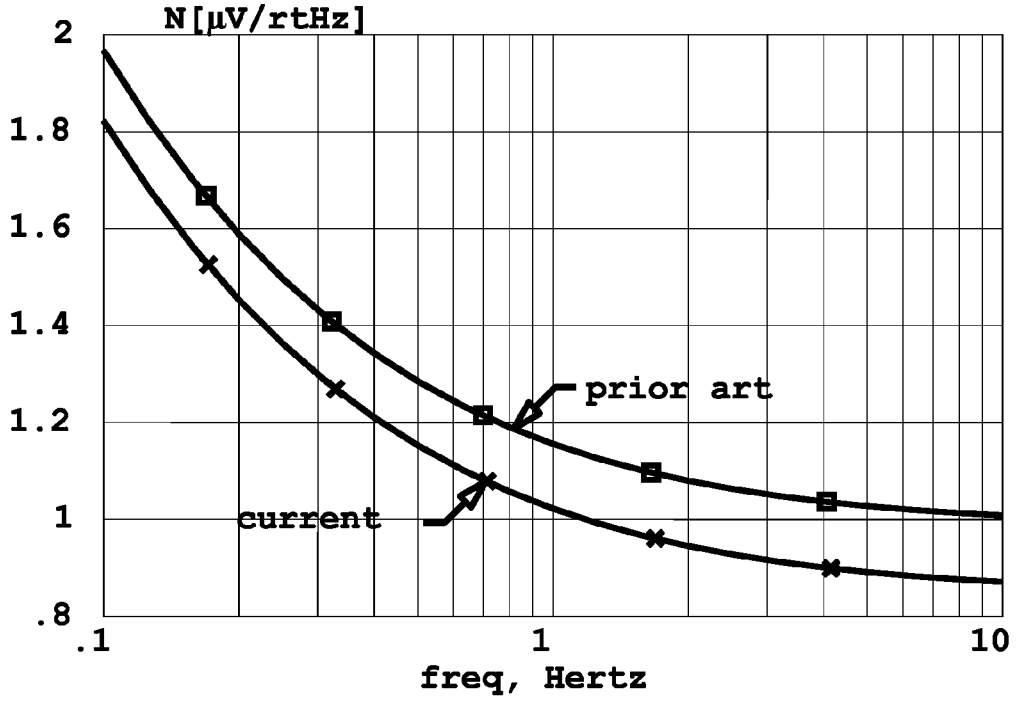
FIG. 6 is a graph showing simulation data of low band (0.1 Hz to 10 Hz) noise spectral density (μV/root Hz) at the output nodes of the circuit of FIG. 1 as compared to that of a known circuit.

Simulated low band (0.1 Hz to 10 Hz) noise spectral density (μV/root Hz) at the output nodes of a circuit per the present teaching as compared to a conventional circuit, as shown in FIG. 6, demonstrates that the noise associated with the output voltage of a circuit per the present teaching is much less than prior art implementations. While it is not intended to limit the present teaching to any one specific understanding it will be appreciated this reduction in noise is achieved at least partially because for the same supply current, the unity bias current $I_{bu}$ is larger for a circuit provided in accordance with the present teaching and the fact that the circuit requires less individual cells to provide the same amount of $\Delta V_{BE}$ at the same output voltage than for corresponding prior art implementations.

It will be appreciated that similarly to other known PTAT circuits that a circuit provided in accordance with the present teaching can be combined with other circuit elements to provide temperature independent voltages or current. Exemplary implementations are shown in FIGS. 7 and 8.

Figure 7:
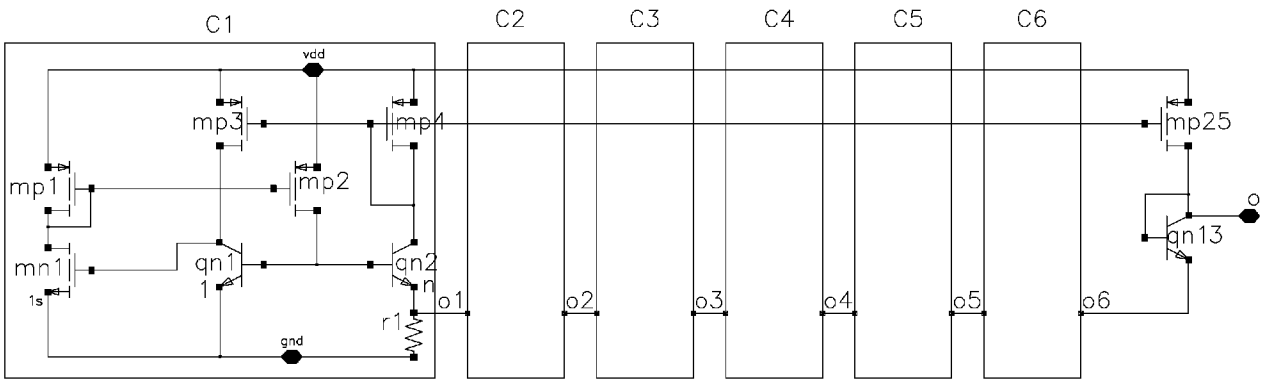
FIG. 7 is a schematic showing components of a circuit configured to generate a temperature independent voltage at an output thereof, in accordance with the present teaching.

In FIG. 7, a bias current generator, C1, is coupled to a plurality of individual $\Delta V_{BE}$ cells provided in a stack arrangement, C2 to C6. Each of these individual $\Delta V_{BE}$ cells are typically provided in a manner similar to that described above. The last cell of the stack is coupled to a bipolar transistor, qn13, and a PMOS device, mp25, which is configured to act as a current mirror. It will be understood that the base-emitter voltage of bipolar transistor qn13 is complimentary to absolute temperature, CTAT. The PTAT voltage at the output of the cell C6 is imposed to balance this CTAT voltage such that at the output node "o" the voltage is, at a first order, temperature independent. The bipolar transistor qn13 can be of substrate type, preferably formed using pnp implementations.

There are many ways to implement a PTAT voltage or a reference voltage based on the present teaching. Where headroom is not a concern, each $\Delta V_{BE}$ cell and the originating bias current generator cell (C1 above) can be made by stacking bipolar transistors in each arm of the cells. By doubling the number of bipolar transistors per cell the output voltage of an individual cell is doubled.

Figure 8:
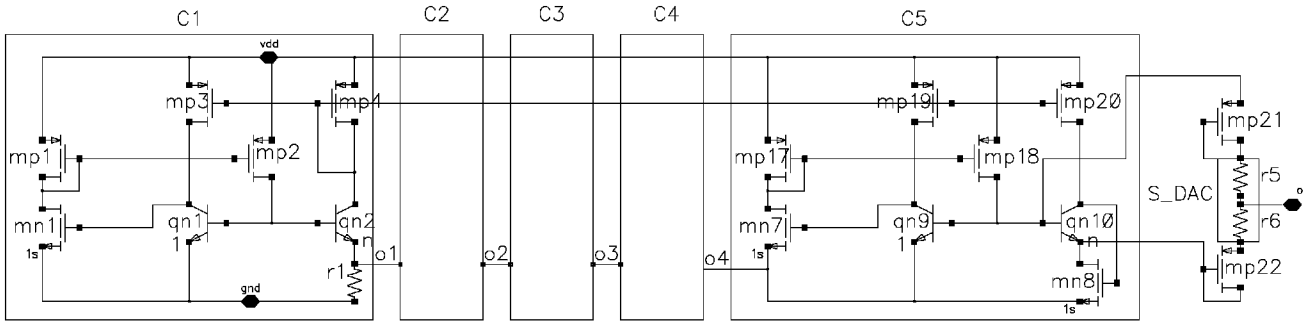
FIG. 8 is a schematic showing components of a circuit configured to generate a temperature independent voltage at an output thereof, in accordance with the present teaching.

FIG. 8 shows another circuit that may be employed in accordance with the present teaching which is very similar to that of FIG. 7. This configuration differs in how the temperature independent voltage is set. For the circuit of FIG. 8, in the last $\Delta V_{BE}$ cell, C5, the base-emitter voltage of qn10 is divided down using two identically diode connected MOS devices mp21 and mp22 and a resistive string DAC, represented here by r5 and r6. Specifically, the base of qn10 is coupled to the source of mp21 and the emitter to the commonly coupled gate and drain of mp22. By providing these diode connected transistors which are assumed to have the same aspect ratio and with their bulk or body terminal connected to the source terminal, the voltage drop across mp21 and mp22 is the same, such that the base-emitter voltage of qn10 is divided in three voltage components. Two of these components have the same value—as provided across mp21 and mp22—and the third across the DAC string which acts as a potentiometer. The main role of mp21 and mp22 is to reduce the voltage drop across the string DAC (here r5 and r6) such that only a small part of the qn10 base-emitter voltage is developed across the string DAC, which can be implemented with small resistances. In this way the effect of a full $V_{BE}$ which is typically of the order of 0.6-0.7 V does not have to be reflected across the individual resistors, thereby allowing use of smaller resistors. The drain currents of mp21 and mp22 exhibit strong nonlinearities and are very much process sensitive, but the voltage in the middle of the base-emitter voltage divider remains insensitive to these variations. The output voltage at the node "o" can be adjusted via the string DAC (r5, r6) in a corresponding trim range for minimum temperature variations.

Figure 9:
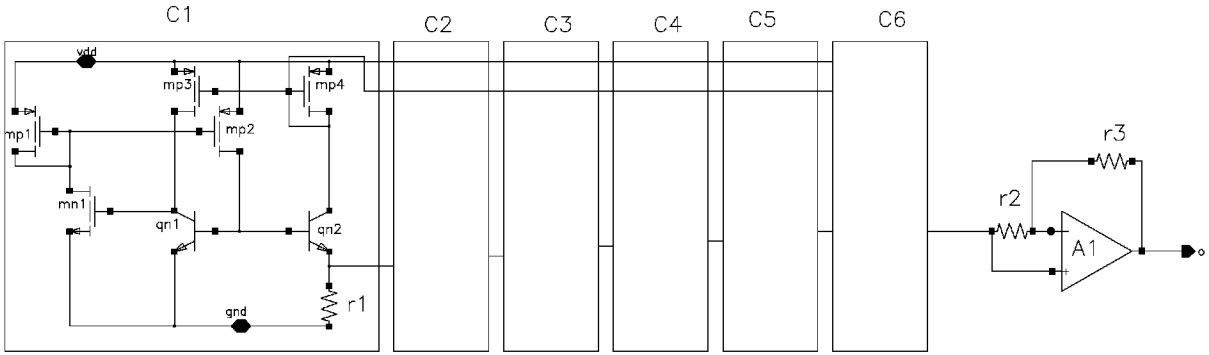
FIG. 9 is a schematic showing components of a circuit configured to generate a PTAT voltage at an output thereof, in accordance with the present teaching.

Another example of a circuit that may be implemented in accordance with the present teaching is shown in FIG. 9. In this example, the last $\Delta V_{BE}$ cell of the stack, C6, is coupled to a differential amplifier A1 which is configured to have an input offset voltage similar to that of r1—from the cell C1. The roll of A1 is to buffer the output PTAT voltage, to generate extra PTAT voltage and to add extra current across r1 to reduce even further the required value of r1.

The voltage of the node "o" of FIG. 9 is determined from:

$$V_o = V_{o6} + V_{r2} * \left(1 + \frac{r_3}{r_2}\right) \tag{4}$$

Here $V_{o6}$ is the voltage at the output node of C6 and $V_{r2}$ is the offset voltage imposed across the input pair of the amplifier A1.

Figure 10:
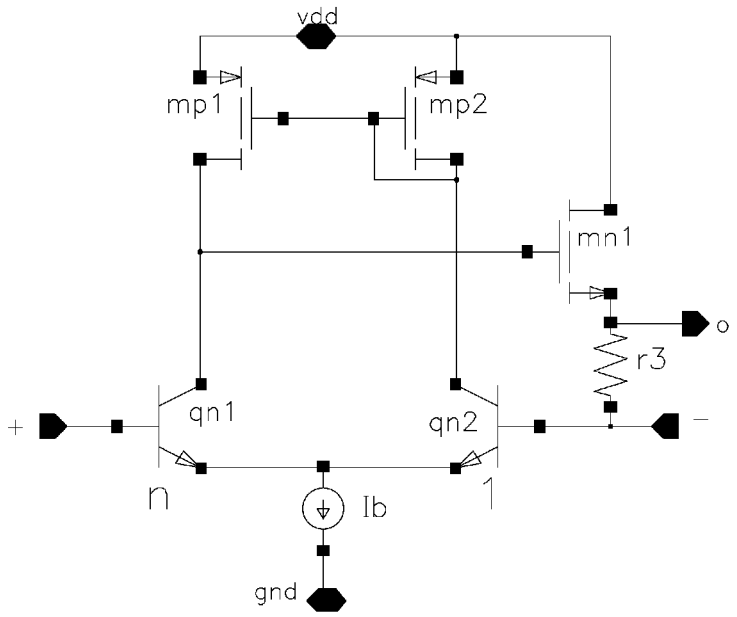
FIG. 10 is a schematic of an exemplary amplifier architecture that may be employed with the circuit of FIG. 9.

An example of a simple two stage differential bipolar amplifier that could be used in the context of the schematic of FIG. 9 is presented in FIG. 10. In this configuration, two input devices, qn1 and qn2, are provided having their emitter area in a ratio of n. For corresponding MOS devices mp1 and mp2 of the same aspect ratio the voltage difference from the two inputs corresponds to $$V_{PTAT} = \frac{KT}{q}\ln(n) \tag{5}$$

It will be appreciated that circuits such as that described above can be stacked or cascaded to generate larger output voltages. It will be appreciated that circuits provided in accordance with the present teaching provide a number of advantages including:

- the output voltage, which is of a form of a proportional to absolute temperature voltage, is very consistent with reduced variability due to process changes and mismatch;
- in a stack arrangement for large PTAT voltage the base-emitter difference of the bias current generator is used as a first $\Delta V_{BE}$ cell such the number of stacked cells for the same output voltage is reduced by one;
- low noise;
- operates in low power environments; and
- can be implemented using less silicon than required for conventional or known arrangements.

It is however not intended to limit the present teaching to any one set of advantages or features as modifications can be made without departing from the spirit and or scope of the present teaching.

The systems, apparatus, and methods of providing a temperature dependent voltage output are described above with reference to certain embodiments. By judiciously combining circuit elements into two or more cell it is possible to effectively dump bias current into an impedance element of a first cell from other cells of the circuit. As a result the circuit as a whole can operate with smaller impedance elements and therefore occupy less area when implemented in silicon. It is also possible to reduce the supply current that is required for providing specific output currents or voltages.

A skilled artisan will, however, appreciate that the principles and advantages of the embodiments can be used for any other systems, apparatus, or methods with a need for a temperature sensitive output.

Additionally, while the base-emitter voltages have been described with reference to the use of specific types of bipolar transistors any other suitable transistor or transistors capable of providing base-emitter voltages could equally be used within the context of the present teaching. It is envisaged that each single described transistor may be implemented as a plurality of transistors the base-emitters of which would be connected in parallel. For example, where circuits in accordance with the present teaching are implemented in a CMOS process, each transistor may be implemented as a plurality of bipolar substrate transistors each of unit area, and the areas of the transistors in each of the arms would be determined by the number of bipolar substrate transistors of unit area connected with their respective base-emitters in parallel.

In general, where the circuits according to the present teaching are implemented in a CMOS process, the transistors will be bipolar substrate transistors, and the collectors of the transistors will be held at ground, although the collectors of the transistors may be held at a reference voltage other than ground.

Such systems, apparatus, and/or methods can be implemented in various electronic devices. Examples of the electronic devices can include, but are not limited to, consumer electronic products, parts of the consumer electronic products, electronic test equipment, wireless communications infrastructure, etc. Examples of the electronic devices can also include circuits of optical networks or other communication networks, and disk driver circuits. The consumer electronic products can include, but are not limited to, measurement instruments, medical devices, wireless devices, a mobile phone (for example, a smart phone), cellular base stations, a telephone, a television, a computer monitor, a computer, a hand-held computer, a tablet computer, a personal digital assistant (PDA), a microwave, a refrigerator, a stereo system, a cassette recorder or player, a DVD player, a CD player, a digital video recorder (DVR), a VCR, an MP3 player, a radio, a camcorder, a camera, a digital camera, a portable memory chip, a washer, a dryer, a washer/dryer, a copier, a facsimile machine, a scanner, a multi-functional peripheral device, a wrist watch, a clock, etc. Further, the electronic device can include unfinished products.

Unless the context clearly requires otherwise, throughout the description and the claims, the words "comprise," "comprising," "include," "including," and the like are to be construed in an inclusive sense, as opposed to an exclusive or exhaustive sense; that is to say, in the sense of "including, but not limited to." The words "coupled" or "connected", as generally used herein, refer to two or more elements that may be either directly connected, or connected by way of one or more intermediate elements. Additionally, the words "herein," "above," "below," and words of similar import, when used in this application, shall refer to this application as a whole and not to any particular portions of this application. Where the context permits, words using the singular or plural number may also include the plural or singular number, respectively. The words "or" in reference to a list of two or more items, is intended to cover all of the following interpretations of the word: any of the items in the list, all of the items in the list, and any combination of the items in the list. All numerical values provided herein are intended to include similar values within a measurement error.

The teachings of the inventions provided herein can be applied to other systems, not necessarily the circuits described above. The elements and acts of the various embodiments described above can be combined to provide further embodiments. The act of the methods discussed herein can be performed in any order as appropriate. Moreover, the acts of the methods discussed herein can be performed serially or in parallel, as appropriate.

While certain embodiments of the inventions have been described, these embodiments have been presented by way of example only, and are not intended to limit the scope of the disclosure. Indeed, the novel methods and circuits described herein may be embodied in a variety of other forms. Furthermore, various omissions, substitutions and changes in the form of the methods and circuits described herein may be made without departing from the spirit of the disclosure. The accompanying claims and their equivalents are intended to cover such forms or modifications as would fall within the scope and spirit of the disclosure. Accordingly, the scope of the present inventions is defined by reference to the claims.

What is claimed is:

1. A proportional to absolute temperature (PTAT) circuit, the circuit comprising:

a first set of circuit components comprising a pair of bipolar transistors operating at different current densities to generate a base-emitter voltage difference as a first voltage component, a resistive load element coupled to an emitter of a bipolar transistor of the set of bipolar transistors, and a bias generator configured to generate a first bias voltage and provide a first bias current to the resistive load element; and a second set of circuit components operably biased by the first bias voltage and providing a second bias current to the resistive load element of the first set of circuit components, wherein the second set of circuit components is configured to generate at least a second voltage component related to a base-emitter voltage difference.

2. The circuit of claim 1, wherein the at least a second voltage component related to a base-emitter voltage difference is generated from an emitter ratio of a third bipolar transistor operating at a first collector current density and a fourth bipolar transistor operating at a second, lower, collector current.

3. The circuit of claim 1, wherein the circuit is configured to combine the first and at least a second voltage component to provide at an output of the circuit a PTAT voltage that is dependent on the base emitter voltage difference between first and second sets of bipolar transistors operating at different current densities.

4. The circuit of claim 1, wherein the second bias current is coupled into the first set of circuit components at a node where the first bias current is generated.

5. The circuit of claim 2, further comprising:

a third set of circuit components configured to generate a third voltage component related to a base-emitter voltage difference generated from an emitter ratio of a fifth bipolar transistor operating at a first collector current density and a sixth bipolar transistor operating at a second, lower, collector current density;

wherein the third set of circuit components is coupled to the second set of circuit components and is operably biased by a voltage originating within the first set of circuit components.

6. The circuit of claim 5, wherein the third set of circuit components is configured to provide a bias current into the first set of circuit components.

7. The circuit of claim 3, further comprising a resistor across which the PTAT voltage is replicated to generate a PTAT current.

8. The circuit of claim 3, further comprising a MOS device operating in a triode region across which the PTAT voltage is replicated to generate a PTAT current.

9. The circuit of claim 3, further comprising a voltage buffer configured to buffer the PTAT voltage and provide a bias current into the first set of circuit elements.

10. The circuit of claim 3, further comprising:

a circuit element configured to generate a complimentary to absolute temperature (CTAT) voltage component, wherein the circuit is configured to couple the CTAT voltage component to the PTAT voltage to provide, at an output of the circuit, an output voltage that is first order temperature insensitive.

11. The circuit of claim 10, wherein the CTAT voltage component comprises a bipolar transistor providing a base emitter voltage which is coupled to the PTAT voltage.

12. The circuit of claim 10, wherein CTAT voltage component is provided by a plurality of diode connected transistors coupled to a bipolar transistor, the diode connected transistors effecting a division of a base-emitter voltage originating from the bipolar transistor into three voltage components.

13. The circuit of claim 12, further comprising a resistor string configured to allow an adjustment of the on voltage.

14. A proportional to absolute temperature (PTAT) circuit configured to generate a voltage at an output node of the circuit that is temperature dependent, the circuit comprising:

a plurality of circuit elements coupled to a single biasing current, a first set of current elements configured to operate as a bias voltage generator, a bias current generator as a first PTAT voltage cell of the circuit, wherein a PTAT voltage is generated at a common node within the first set of circuit elements; and a second set of circuit elements biased using the bias voltage generated from the first set of circuit elements and configured to return at least one bias current to the common node within the first set of circuit elements, wherein the second set of circuit elements includes a second PTAT cell of the PTAT circuit.

15. The circuit of claim 14, wherein the second set of circuit elements are arranged in at least two individual cells, each individual cell configured to generate a PTAT voltage.

16. The circuit of claim 15, wherein an output PTAT voltage of the circuit is a compound voltage generated by combining individual PTAT voltages from each individual cell.

17. The circuit of claim 16, further comprising a circuit element configured to generate a complimentary to absolute temperature (CTAT) voltage component, the circuit being configured to couple the CTAT voltage component to the output PTAT voltage to provide, at an output of the circuit, an output voltage that is first order temperature insensitive.

18. The circuit of claim 17, wherein the CTAT voltage component comprises a bipolar transistor providing a base emitter voltage which is coupled to the output PTAT voltage.

19. The circuit of claim 17, wherein the CTAT voltage component is provided by a plurality of diode connected transistors coupled to a bipolar transistor, the diode connected transistors effecting a division of a base-emitter voltage originating from the bipolar transistor into three voltage components.

20. The circuit of claim 19, further comprising a resistor string configured to allow an adjustment of the output voltage.

21. A method of generating a proportional to absolute temperature (PTAT) voltage, the method comprising:

coupling a plurality of circuit elements to a single biasing current;

configuring a first set of circuit elements to operate as a bias voltage generator, a bias current generator and as a first PTAT voltage cell of a circuit, wherein a PTAT voltage is generated at a common node within the first set of circuit elements;

biasing a second set of circuit elements using the bias voltage generated from the first set of circuit elements, wherein the second set of circuit elements returns at least one bias current to the common node within the first set of circuit elements;

configuring the second set of circuit elements to operate as a second PTAT cell of the circuit; and combining PTAT voltages from the first and second PTAT cells of the circuit at an output of the circuit to generate a PTAT voltage.

22. The method of claim 21, further comprising coupling the PTAT voltage to a voltage having a complimentary to absolute temperature (CTAT) form to generate at an output of the circuit a voltage that is first order temperature insensitive.

23. The method of claim 21, further comprising generating a PTAT current by replicating the PTAT voltage across a resistive load.

24. The method of claim 21, further comprising providing a voltage buffer at the output of the circuit to buffer the PTAT voltage.

25. The method of claim 22, further comprising providing a voltage divider configured to divide down the voltage having a complimentary to absolute temperature (CTAT) form.

* * * * *